United States Patent [19]

Hutchings et al.

[11] Patent Number: 4,722,802

[45] Date of Patent: Feb. 2, 1988

[54] PROCESS FOR THE MANUFACTURE OF SURFACTANT CLEANSING BLOCKS AND COMPOSITIONS THEREOF

[75] Inventors: Richard S. Hutchings; Robert R. Ziek, Jr., both of Cincinnati, Ohio

[73] Assignee: The Drackett Company, Cincinnati, Ohio

[21] Appl. No.: 844,409

[22] Filed: Mar. 26, 1986

[51] Int. Cl.[4] ..... C11D 17/00

[52] U.S. Cl. ..... 252/174; 252/174.17; 252/174.23; 252/DIG. 2

[58] Field of Search ..... 252/174, 174.23, 174.17, 252/DIG. 2, DIG. 16

[56] References Cited

U.S. PATENT DOCUMENTS

| | | | |
|---|---|---|---|
| 3,081,267 | 3/1963 | Laskey | 252/135 |
| 3,314,809 | 4/1967 | Klug | 106/197 |
| 3,378,495 | 4/1968 | Buck, Jr. | 252/107 |
| 3,424,842 | 1/1969 | Nürnberg | 424/94 |
| 3,630,925 | 12/1971 | Buck, Jr. | 252/107 |
| 3,803,285 | 4/1974 | Jensen | 264/143 |
| 4,020,015 | 4/1977 | Bevan | 252/544 |
| 4,043,931 | 8/1977 | Jeffery et al. | 252/106 |
| 4,119,578 | 10/1978 | Daeninckx et al. | 252/174 |
| 4,155,742 | 5/1979 | Sakurai et al. | 71/67 |
| 4,229,410 | 10/1980 | Kosti | 424/76 |
| 4,269,723 | 5/1981 | Barford et al. | 252/174.23 |
| 4,396,522 | 8/1983 | Callicott et al. | 252/DIG. 2 |
| 4,438,015 | 3/1984 | Huber | 252/174.23 |
| 4,460,490 | 7/1984 | Barford et al. | 252/174.17 |
| 4,578,207 | 3/1986 | Holdt et al. | 252/174.23 |
| 4,587,031 | 5/1986 | Kruse et al. | 252/135 |

FOREIGN PATENT DOCUMENTS

| | | |
|---|---|---|
| 1364460 | 8/1974 | United Kingdom . |
| 1364459 | 8/1974 | United Kingdom . |
| 1465475 | 2/1977 | United Kingdom . |
| 2021143 | 11/1979 | United Kingdom . |
| 2089830 | 6/1982 | United Kingdom . |

*Primary Examiner*—Paul Lieberman
*Assistant Examiner*—Willie J. Thompson
*Attorney, Agent, or Firm*—Charles J. Zeller

[57] ABSTRACT

A surfactant cleansing block suitable for placement in a toilet tank or other water-containing reservoir, comprising a hydrated cellulosic binder and a surfactant, and processes for making same, especially by extrusion of a homogeneous blend of said binder and said surfactant.

68 Claims, No Drawings

PROCESS FOR THE MANUFACTURE OF SURFACTANT CLEANSING BLOCKS AND COMPOSITIONS THEREOF

FIELD OF INVENTION

The present invention concerns improvements in surfactant cleansing blocks suitable for placement in a toilet tank or other water-containing reservoirs, the surface active agent in said cleansing block being available for gradual release over an extended period of time. More specifically, the present invention concerns a process for making said blocks, as well as compositions therefor. Most specifically, the present invention concerns the extrusion of said blocks.

BACKGROUND OF INVENTION

U.S. Pat. No. 4,269,723 to Barford, et al., discloses a process for making lavatory cleansing blocks by tableting a free flowing particulate mix consisting essentially of on a weight basis from 5 to 90% of a surface active component and from 0.5 to 75% of one or more binders selected from clays and water soluble or water dispersible gel forming organic polymeric materials. Of the water soluble polymeric binders, Barford makes mention of chemically modified celluloses such as ethyl cellulose, methyl cellulose, sodium carboxymethyl cellulose, ethyl hydroxyethyl cellulose, and the like. Various optional components are also mentioned by Barford; namely, dyestuffs, perfume, water soluble fillers, water softening or chelating agents, solid water soluble acids, inert water insoluble inorganic or organic fillers, tablet lubricants, and agents having disinfecting or germicidal activity.

U.S. Pat. No. 4,460,490 to Barford, et al., discloses a freestanding lavatory cleansing block that comprises a shaped body formed of a slow dissolving cleaning composition containing a surface active agent and a tablet comprising a bleaching agent embedded in or adhered to the shaped body. The shaped body, according to the '490 patent, may be melt cast, tableted, or extruded, depending upon the geometry of the shaped body. The shaped body preferably comprises the aforesaid surface active agent and a solubility control agent, for example, a water soluble or water dispersible gel forming polymer, for example, chemically modified celluloses.

U.S. Pat. No. 4,438,015 to Huber discloses lavatory cleansing blocks comprising as a solid carrier base a mixture comprising a major proportion of a nonionic surface active compound and a minor proportion of a partially esterified copolymer of vinylmethyl ether and maleic anhydride (PVM/MA). The blocks of Huber are melt cast.

U.S. Pat. No. 4,043,931 to Jeffrey, et al., discloses a lavatory cleansing block comprising a solid carrier base which is a mixture of two or more nonionic surface active agents, one of which is relatively insoluble in water and the other of which is relatively soluble in water. Suitable relatively water insoluble nonionic surface active agents are the mono- and dialkanolamides of long chain fatty acids, and polyalkoxylated fatty alcohols containing up to 6 moles of alkoxide. Suitable relatively water soluble surface active agents include polyalkoxylated fatty alcohols of more than 6 alkyleneoxy units per molecule and the alkyleneoxy block copolymers. The lavatory block of Jeffrey may optionally include perfume, dyestuff, germicide, and fillers, the latter being for example, a water softener such as a alkali metal polyphosphate. The blocks of Jeffrey are made by tableting.

U.S. Pat. No.4,229,410 to Kosti discloses a bacteriostatic toilet element comprising a water sensitive, water soluble or swellable binding agent and a bacteriostatic and/or deodorizing and/or coloring agent. Kosti's element may be melt cast or extruded.

U.S. Pat. No. 4,119,578 to Daeninckx, et al., discloses a hydrosoluble bar obtained by extrusion, the bar containing paraffin sulfonate as an extrusion aid.

SUMMARY OF INVENTION

It is an object of the present invention to provide an improved process for the manufacture of surfactant cleansing blocks comprising a surface active agent and a hydrated cellulosic binder.

It is a further object to provide surfactant cleansing blocks made in accordance with the process.

It is a primary object of the present invention to provide a surfactant cleansing block characterized by good integrity in aqueous media, thereby achieving a gradual release of the surface active agent over an extended period of time.

Another object of the present invention is to provide a extrudable mass that can be handled throughout the extrusion and post-extrusion unit operations, the extruded block leaving the extruder being characterized by timely hardening or curing.

Yet another object of the present invention is to provide an extrudable mass that lends itself to processing at extruder operating conditions that are designed to optimize the cleansing blocks' aforesaid characteristic good integrity.

These and other objects of the present invention will be readily apparent from the discussion of detailed description of the invention that follows subsequently.

The present invention broadly concerns a process for manufacturing a formed cleansing block adapted for slow dissolution in aqueous media. In a preferred embodiment of this aspect of the invention, the cleansing block is an extruded article or extrudate. Another aspect of the present invention concerns the composition of the cleansing block.

The process for the manufacture of the formed cleansing block according to the present invention comprises, in the broad embodiment, the steps of forming a homogeneous mixture of hydrated cellulose or cellulose derivative as a binder and a surfactant, forming the cleansing block from the homogeneous mixture, and allowing the formed block to cure.

In the preferred embodiment of the process, the homogeneous mixture comprising the hydrated cellulose and the surfactant is charged to the barrel of an extruder, and passed through the extruder die. The extrudate leaving the die is then cut to obtain cleansing blocks of predetermined size, and thereafter allowed to complete its curing. Curing commences as the extrudate leaves the extruder, and curing time is a function of the process parameters and the composition of the mixture being extruded, as hereinafter described.

The blocks of the present invention comprise a hydrated cellulose material and the surfactant. The cellulose constituent is hydrated prior to blending with the surfactant using a hydroxy-containing compound having hydroxy groups available for sorption. However, the homogeneous mixture comprising the hydrated cellulose binder and the surfactant may also be obtained by admixture of the cellulose binder and a solution or dispersion of the surfactant, the solvent being the hydroxy-containing compound. Preferably, the cellulose binder is hydrated with water. Optionally, fillers or diluents, especially inorganic diluents, an organic oil, and one or more adjuvants, for example, dye, fragrance, preservative, and germicide, may be included.

Any cellulose material capable of sorbing a hydroxy-containing material is suitable for use in the present process and in the manufacture of blocks contemplated herein. Preferably, the cellulose material is a hydroxyalkyl cellulose having from 1 to about 6 carbons in the alkyl moiety, most preferably from 1 to 4 carbons.

Typically, the hydrated cellulose is present in an amount of from 10 to 50% by weight of the block composition, while the surfactant and optional constituents comprise the remainder. Where an organic oil is included in the lavatory block composition, it is essential that the cellulose binder be hydrated before admixture of the oil.

DETAILED DESCRIPTION OF THE INVENTION

By way of definition, the term "block" as used herein means formed, solid composition of matter articles obtained in accordance with the processes described herein. "Hydrated cellulose" means a cellulosic material, preferably hydroxyalkyl cellulose, that has sorbed a hydroxy-containing compound whose hydroxy groups are available for sorption. "Curing" means the substantial hardening of the soft homogeneous blend of admixed constituents comprising the block subsequent to the termination of shear forces acting thereon.

The blocks of the present invention comprise a hydrated cellulose material and surfactant. It has been found that hydration of the cellulose material prior to blending with anhydrous surfactant or with an organic oil (including organic fragrance oils) is advantageous in several respects, and overcomes certain processing difficulties inherent in the manufacture of surfactant containing cleansing blocks, particularly cleansing blocks manufactured by extrusion.

Firstly, hydration of the cellulose, which acts as a binder to retain the shape of the blocks of the present invention when they are immersed in aqueous media, improves handleability of the blend of constituents comprising the block during the latter stages of the manufacturing process. This is especially important in extrusion of the homogeneous blend. Hydration accelerates curing of the block thereby permitting high speed extrusion and on-line cutting of the extrudate. It has been found that blocks manufactured with hydroxyalkyl cellulose that has not been hydrated have a tendency, when placed in aqueous media, to swell, it is believed as a consequence of water absorption, the swelling deleteriously affecting block integrity. Hydrated hydroxyalkyl cellulose blocks, on the other hand, have reduced tendency to swell and deteriorate resulting in longer-lived blocks. Finally, it has been found that the degree of hydration of the hydrated hydroxyalkyl cellulose is a variable that may be regulated to provide flexibility in process operation and/or product characteristics.

In the preferred extrusion process, it has been found that heat to or generated in the barrel of the extruder negatively affects the process and the product. Extrudate that leaves the die at too high a temperature is difficult to handle, and there is a reduction in the length of life of such a product block in view of inferior block integrity in aqueous media. It is believed that heat decouples the hydroxy-containing compound from the hydrated cellulosic binder permitting possible interactions with other constituents, thereby resulting in the negative effects recited above. It has also been advantageously found that the presence of the organic oil further permits regulation of curing downstream of the extruder die, and improves cutability of the extrudate leaving the die.

In the broad aspect of the process of the present invention, the cellulose binder is first hydrated using a hydroxy-containing compound by admixing these constituents in a conventional mixing device. Suitable mixers include ribbon blenders, Littleford and Marion mixers, and conical mixers. Mixing time is a function of the composition of the mixture, rate of charging and time of charging, mixer size and type, and shear rate or blade size. Time for mixing should be sufficient to allow the hydroxy-containing compound to be sorbed by the cellulose and to homogeneously blend the materials, but without excessive shear, which could initiate in situ curing. While not wishing to be bound by any particular theory, it is believed that the hydroxy groups of the hydroxy-containing compound are coupled to the hydroxy groups in the cellulose by hydrogen bonding.

The cellulose constituent may be any cellulosic material capable of sorbing the hydroxy-containing compound. Such celluloses include cellulose, hydroxyalkyl cellulose including hydroxyalkyl celluloses that are lower alkyl cellulose derivatives, carboxyalkyl cellulose and soluble salts thereof, alkyl cellulose, and the like. Alkyl chain lengths for the alkylated cellulose materials of from 1 to about 6 carbons are suitable, while from 1 to 4 carbons are preferred. Preferably, the cellulose material is hydroxyalkyl cellulose, hydroxyethyl cellulose being most preferred. It has been found that cure time of the block product increases with the number of carbon atoms in the alkyl group in the preferred hydroxyalkyl cellulose.

The hydroxy-containing compound may be any compound capable of being sorbed by the cellulose. Suitable compounds are those having at least 30%, preferably greater than 60% by weight, hydroxy groups, and include, for example, water, alcohols, especially ethyl and isopropyl alcohol, glycols, and polyalkylene glycols. Water is preferred. The weight ratio of hydroxyalkyl cellulose to water is from about 30:1 to about 2:1, preferably from about 10:1 to 3:1. Characteristically, hydrated hydroxyalkyl cellulose is preferably dry or slightly tacky to the touch. Water not effectively associated with the cellulosic material may detrimentally interact with the other components. When hydrated, the hydroxyalkyl cellulose swells and has a fluffy texture.

The hydroxy-containing compound may also be used as a vehicle in which to provide one or more of the other constituents of the block of the present invention. Thus, it is convenient when water is the hydroxy-containing compound to hydrate the cellulose with an aqueous dye solution, the dye being released during use to provide an aesthetic hue to the reservoir water. In addition, all or a portion of the surfactant may also be dissolved in the hydroxy-containing compound. The critical aspect of the invention is that the cellulose be hydrated prior to adding anhydrous surfactant, organic oils, or other constituent that would jeopardize proper hydration of the cellulose with the hydroxy-containing compound, for example, by forming a water-repelling film on the cellulose particles. Accordingly, although not preferred, constituents that do not jeopardize hydration may be admixed with the cellulose material prior to the hydration step.

Addition of the hydroxy-containing compound is preferably done by a sparger that atomizes it into the mixer during the mixing process.

After hydration of the cellulosic material is substantially completed, those constituents to be included in the composition that are apt to jeopardize proper hydration ar then added to the mixing device, preferably by gradual introduction thereof. The order of addition of these remaining constituents is not critical. However, it is preferred to blend in the organic oil in advance of the surfactant constituent. Liquids may be sparged into the mixing device during continued mixing of the now hydrated cellulose. Alternatively, two or more of the remaining constituents may be introduced simultaneously into the mixing device or blended together separately as a premix which is then introduced into the mixing device. It is preferred to add the remaining constituents gradually to the mixing device to ensure uniform distribution thereof within the composition.

Mixing time should be sufficient to obtain a homogeneous blend of all of the constituents, and should not be so long as to allow any great degree of in situ curing. In the broad aspect of the process of the present invention, metered amounts of the homogeneous blend may then be formed, e.g., by dispensing a given amount thereof onto a suitable surface such as a moving conveyor to obtain the shaped cleansing blocks. In such process, the homogeneous blend has a doughlike consistency obtained, for example, by mixing in a kneading-type mixer, e.g., a Sigma mixer. The shaped solid surfactant cleansing blocks thus formed are then allowed to cure before packaging. Cure time is less than about 15 minutes, typically between 1 to 10 minutes, and depends upon the composition of the blend and its manner of processing.

An extrusion process is preferred. In the preferred extrusion process, the homogeneous blend has a granular consistency obtainable at less shear than the blend described in the preceding paragraph. Accordingly, mixers such as the aforementioned ribbon blender are preferably used. The blend is then fed to the barrel of a screw extruder, and passed through the extruder to form a continuous extrudate which is then cut to the size block desired. The pressure through the dye is typically less than about 250 psig. Unlike many conventional extrusion processes, the barrel of the extruder is maintained at less than about 110° F., preferably at less than about 95° F., for the reasons previously cited. Most preferably, the barrel is kept at ambient temperature by means of cooling water circulated through an external barrel jacket. The die head may be heated to between about 85° to about 120° F., preferably less than about 110° F., to assure a smooth surface of the product extrudate. The block in said continuous extrudate form begins to cure upon leaving the extruder, and hence is cut into cleansing blocks of requisite size by conventional cutting means as soon as practicable downstream of the die and before substantially complete curing. Ability to cut the continuous extrudate is enhanced by presence of the organic oil.

Typically, the blocks of the present invention weigh from 30 to 60 grams, and have a life of from 30 to 60 days installed in a toilet tank, based on normal use. The length of life of the product blocks will depend on a variety of factors including product formulation, water temperature, tank size, and the number of flushes over the period of use. The blocks are typically cylindrical in shape, having a length of from about ½ to about 2 inches and having a diameter of about 1 to about 3 inches.

Surfactants include anionic, nonionic, amphoteric, and zwitterionic surfactants, whose melting points are sufficiently high, above about 110° F., preferably above 125° F., to permit processing. Small amounts of low melting point surfactants and even liquid surfactants are, however, tolerable in formulating a surfactant blend. A cationic surfactant may be incorporated as a germicide or as a cosurfactant. Anionic surfactants include, for example, alkyl aryl sulfonates, long-chain fatty alcohol sulfates, olefin sulfates and sulfonates, soaps, and alkane sulfonates. Preferred anionics are sodium alkyl aryl sulfonate, alpha-olefin sulfonate, and fatty alcohol sulfates. Nonionic surfactants include, for example, alkoxylated fatty alcohols, alkoxylated alkyl phenols, fatty acid condensates, the reaction products of ethylene oxide with an amine or an amide, alkylolamides, and fatty amine oxides. Preferred nonionics are decyl- and tridecyloxypoly (ethyleneoxy) ethanol and condensates of ethylene and propylene oxide with hydrophobic bases formed by condensing propylene and ethylene oxide with propylene or ethylene glycol.

It has been found that addition of a organic oil is beneficial as a lubricant to assist homogeneous blending of the constituents. The organic oil may be glycerin, paraffinic and naphthenic hydrocarbons, low molecular weight polyethylene glycols, and the like. It is, however, most convenient to use as the organic oil an oily perfume compound, for example, eugenol, limonene, methyl salicylate, ethyl salicylate, and ethyl succinate.

Diluents are included to provide additional bulk of the product block and may enhance leaching out of the surfactant constituent whe the block is placed in water. The diluents are typically any soluble inorganic alkali, alkaline earth metal salt or hydrate thereof, for example, sodium sulfate, sodium chloride, sodium borate, magnesium chloride, magnesium sulfate, and sodium carbonate. Organic diluents might include high molecular weight polyethylene glycol and polypropylene glycol.

The dye is water soluble. A particularly suitable dye is Colour Index No. dye 42,090 to provide a blue color to the aqueous media in which the block is placed.

Other adjuvants include bacteriocides, for example, Dowicil 75 manufactured by Dow Chemical, builders, chelating and sequestering agents, buffers, enzymes, bleaches, and activating agents for bleaches.

A suitable composition of the cleansing blocks of the present invention comprises on a weight basis from about 10 to about 50% hydrated cellulose; from about 20 to 60% surfactant; from 0 to about 15% organic oil; from 0 to about 30% filler or diluent, and less than about 5% each of the optional adjuvants. A preferred composition hereunder is from about 20 to about 40% hydrated hydroxyalkyl cellulose wherein the hydration is obtained by admiing the cellulose and water; from about 30 to 50% surfactant; from about 2 to about 10% of an organic perfume oil; from about 10 to about 20% inorganic alkali metal salt diluent; about 0.1 to about 1% bacteriocide, and about 1 to about 5% dye.

The present invention is illustrated by the examples that follow.

Except as noted in a specific case, in the examples which follow, cleansing blocks made in accordance with this invention were prepared by first hydrating the cellulosic binder by gradually adding water and/or an aqueous solution of a dye to a Day Company ribbon blender containing the cellulosic bender to obtain an intimate mixture thereof. Following this hydration step, the other constituents were then added gradually to the ribbon blender in the following order: organic oil, diluent, surfactant, other adjuvants. For ease of processing, it was found that addition of the organic oil in advance of the anhydrous surfactant was preferred. Cleansing blocks not in accordance with this invention were prepared similarly, except that the water/aqueous solution addition step was omitted.

EXAMPLE 1

The following cleansing blocks were made by extrusion of a homogeneous mixture of the stated constituents:

| Constituent | Weight in Grams Block A | Weight in Grams Block B |
|---|---|---|
| Pluronic F-127[1] | 21.35 | 22.85 |
| Methysalicylate | 3.65 | 3.95 |
| Cellosize QP 52000[2] | 12.85 | 13.90 |
| Dye[3] | | |
| Solids | 1.725 | 0 |
| Water | 1.725 | 0 |
| Sodium Sulfate | 8.60 | 9.30 |
| Preservative | 0.10 | 0 |
| Total | 50.0 | 50.0 |

[1]A solid, nonionic polyol surfactant, 100% active, that is a condensate reaction product of ethylene oxide with hydropholic bases formed by condensing propylene oxide with propylene glycol, HLB = 22.0; melting point = 133° F.; MW = 12,500. Manufactured by BASF Wyandotte, Industrial Chemical Group.
[2]Hydroxethyl cellulose manufacture by Union Carbide.
[3]For Block A, the dye was a 50% aqueous solution of dye solids. For Block B dye in powder form was used.

The homogenous blends from which the Blocks A and B were extruded were processed substantially similarly. However, in preparing the Block A homogenous extrudable mass, the Cellosize and dye slurry was first intimately blended in order to hydrate the Cellosize, followed by addition of the remaining ingredients. The homogeneous extrudable anhydrous blend for Block B was prepared by intimate mixture of all ingredients. The order of addition of the ingredients for each of Blocks A and B was identical, except in respect of the hydration step. The mixing device was a Day ribbon blender, and mixing was conducted for substantially similar times and at substantially identical rates of shear.

The respective blends were each transferred from the mixer to the feed hopper of a single screw Bonnot extruder. The extruder comprised a barrel within which the extruder screw urged the blends through a perforated breaker plate and into a spacer section defined at the upstream end by said breaker plate and at the downstream end by the die. The respective extrudates leaving the die were then cut into the subject Blocks A and B.

The extruder was equipped with a jacket through which water could circulate. The extruder barrel was at ambient temperature when extruding Block A. It was necessary in order to extrude the blend for Block B to keep the extruder barrel at about 110° F. The die head temperature was 105° F. for extrusion of Block A, and 110° F. for extrusion of Block B. The extrudates leaving the die were cut into the Blocks A and B and allowed to harden or cure.

Several of each of the cured Blocks A and B were tested by monitoring toilet tanks each containing a block. The toilets were flushed automatically 10 times a day at periodic intervals over the course of the test. The monitoring was discontinued upon complete dissolution of the subject block. On average, Block A completely disappeared after 56 days, while Block B on average completely dissolved after 24 days.

EXAMPLE 2

The extrusion of Block A was compared to the extrusion of another Block C and to Block B to ascertain the functional relationships of cellulosic binder hydration and organic oil inclusion on curing time of the extrudate. Block C had the composition:

| Constituent | Weight in Grams Block C |
|---|---|
| Pluronic F-127 | 23.05 |
| Methysalicylate | 0 |
| Cellosize QP 52000 | 13.85 |
| Dye: | |
| Solids | 1.85 |
| Water | 1.85 |
| Sodium Sulfate | 9.30 |
| Preservative | 0.10 |
| Total | 50.0 |

Blocks A and C were prepared by first hydrating the Cellosize binder. Block B was prepared without hydration of the Cellosize, but included methylsalicylate as the organic oil. The organic oil was not included in the preparation of Block C.

These three blocks were prepared in substantially the same way, but for the hydration step used in the making of Blocks A and C. Also, the extruder barrel had to be kept warm in order to make Block B. The barrel was at ambient temperature in the making of Block C.

Block C cured very rapidly as it left the die. Block A cured within 10 to 15 minutes of leaving the die, while Block B cured about 30 minutes after leaving the die.

These observations suggest that hydration of the Cellosize accelerates curing. The experiments further indicate that hydration of the cellulosic binder and the presence of methylsalicyate operate together to optimize curing time in respect of downstream handling packaging and storage. When tested in accordance with the protocol of Example 1, Block C dissolved on average after about 56 days.

EXAMPLE 3

Samples of Block A were placed in an oven for 28 days at 125° F. The thus treated blocks softened, but did not melt or flow, although surface melting was observed. When removed and cooled, the treated blocks hardened.

These treated blocks, designated as Block A', were placed in toilet tanks and tested in accordance with the protocol described in Example 1. As compared to the Block A samples, the Block A' lasted from one-third to one-half as long. It is believed that the heating of the Block A' samples decoupled water from the hydroxyethyl cellulose in the block, resulting in more rapid dissolution in the toilet tank.

EXAMPLE 4

The Blocks D, E and F were prepared in accordance with the present invention:

| Constituent | Weight in Grams | | |
|---|---|---|---|
| | Block D | Block E | Block F |
| Emulphogene TB-970[4] | 21.35 | 10.15 | 0 |
| Pluronic F-127 | 0 | 10.15 | 22.0 |
| Methysalicylate | 3.65 | 3.65 | 0 |
| Glycerin | 0 | 0 | 3.0 |
| Cellosize | 12.85 | 12.85 | 12.85 |
| Water[5] | 0 | 1.75 | 0 |
| Dye: | | | |
| Solids | 1.725 | 1.15 | 1.725 |
| Water | 1.725 | 1.15 | 1.725 |
| Sodium Sulfate | 8.60 | 8.60 | 8.60 |
| Borax | 0 | 0.20 | 0 |
| Preservative | 0.1 | 0.10 | 0.10 |
| Fragrance | 0 | 0.25 | 0 |
| Total | 50.0 | 50.0 | 50.0 |
| Extruder Barrel, °F. | 67 | 75 | 75 |
| Extruder Die, °F. | 95 | 105 | 120 |

[4]Tridecyloxypoly (ethyleneoxy) ethanol, 100% active, nonionic solid surfactant. GAF Corp.
[5]Free water added to Cellosize along with dye solution in hydration step.

Blocks D, E, and F lasted for about 7–8 weeks in tests similar to those recited in Example 1, and all provided acceptable performance. No processing difficulties were encountered.

EXAMPLE 5

The following Blocks G–J were prepared in accordance with the present invention. Blocks G and H were extruded; Blocks I and J were prepared by forming the cleaning blocks from a doughlike homogeneous mixture of constituents.

| Constituent | Weight in Grams | | | |
|---|---|---|---|---|
| | Block G | Block H | Block I | Block J |
| Pluronic F-127 | 21.35 | 21.35 | 16.35 | 16.35 |
| Methylsalicylate | 3.65 | 3.65 | 0 | 0 |
| Cellulosic Binder | 12.85[6] | 12.85[7] | 9.8[8] | 9.8[7] |
| Water[5] | 0 | 0 | 10.8 | 10.8 |
| Dye: | | | | |
| Solids | 1.725 | 1.725 | 0 | 0 |
| Water | 1.725 | 1.725 | 0 | 0 |
| Sodium Sulfate | 8.60 | 8.60 | 6.55 | 6.55 |
| AQ-55D:[9] | | | | |
| Polymer | 0 | 0 | 4.585 | 4.585 |
| Water | 0 | 0 | 1.965 | 1.965 |
| Total | 50.0 | 50.0 | 50.0 | 50.0 |
| Extruder Barrel, °F. | Ambient | 67 | — | — |
| Extruder Die, °F. | 110 | 105 | — | — |

[6]Hydroxypropylmethylcellulose. Methocel J 75 MS; Dow Chemical Co.
[7]Hydroxybutylmethylcellulose. Methocel HB; Dow Chemical Co.
[8]Sodium carboxymethylcellulose. Cellulose Gum CM; Hercules Chemical Corp.
[9]Water dispersible polymer manufactured by Eastman Chemical Co.

All Blocks G–J were found acceptable. Cure time for the Block I compositions was greater than that for Block A, but less than for Block J wherein the cellulosic binder was hydroxybutylcellulose. Block A outlasted Blocks I and J, and accordingly is preferred.

We claim:

1. A process for the manufacture of a formed cleansing block adapted for slow dissolution in aqueous media the process comprising the steps of forming an uncured block from a homogeneous blend comprising a hydrated cellulosic material and a surfactant, and permitting the uncured formed block to cure.

2. The process of claim 1 wherein the cellulosic material is selected from the group consisting of hydroxyalkyl cellulose having from 1 to about 6 carbons in the alkyl group, carboxyalkyl cellulose having from 1 to about 6 carbons in the alkyl group, hydroxycellulose, cellulose, and alkyl cellulose having from 1 to about 6 carbons in the alkyl group.

3. The process of claim 1 wherein the cellulosic material is hydroxyalkyl cellulose having from 1 to 6 carbons in the alkyl group.

4. The process of claim 3 wherein the alkyl group of the hydroxyalkyl cellulose contains from 1 to 4 carbon atoms.

5. The process of claim 1 wherein the homogeneous blend further comprises one or more of the following optional constituents: an organic oil, a diluent, and an adjuvant selected from the group consisting of dyes, fragrances other than organic oils, and bacteriocides, the process further comprising the step of first hydrating a cellulosic material with a compound containing hydroxy groups available for sorption by said cellulosic material, the weight ratio of the cellulosic material to the hydroxy-containing compound in the hydrated cellulosic material being from about 30:1 to about 2:1, said hydrxy-containing compound being available as a vehicle for the incorporation of the surfactant and the optional constituents into the homogeneous blend, the surfactant and the optional constituents being of a nature and of an amount compatible with the proper hydration of the cellulosic material, said homogeneous blend being formed by mixing the cellulosic material and the hydroxy-containing compound and thereafter admixing with the hydrated cellulosic material that portion of the surfactant and of the one or more optional constituents not incorporated with said hydroxycontaining compound.

6. The process of claim 5 wherein the hydroxy-containing compound is about 30% by weight hydroxy or greater.

7. The process of claim 6 wherein the hydroxy-containing compound is selected from the group consisting of water, alcohols, and glycols including polyethylene glycols.

8. The process of claim 5 wherein the hydroxy-containing compound is water.

9. The process of claim 7 wherein the cellulosic material is hydroxyalkyl cellulose having from 1 to about 6 carbons in the alkyl group.

10. The process of claim 9 wherein the alkyl group of the hydroxyalkyl cellulose has from 1 to 4 carbon atoms.

11. The process of claim 10 wherein the weight ratio of hydroxyalkyl cellulose to hydroxy-containing compound is about 10:1 to about 3:1.

12. The process of claim 11 wherein the hydroxy-containing. compound is water.

13. The process of claim 12 wherein the homogeneous blend comprises on a weight basis from about 10 to about 50% hydroxyalkyl cellulose; from about 20 to about 60% of a surfactant selected from the group of anionic and nonionic surfactants; from about 0 to about 15% organic oil; from about 0 to 30% diluent, and less than about 5% each of one or more adjuvants.

14. The process of claim 13 wherein the weight ratio of surfactant to hydrated hydroxyalkyl cellulose is from about 1:1 to about 4:1.

15. The process of claim 13 wherein in the formation of the homogeneous blend the organic oil is introduced in advance of the surfactant, the homogeneous blend having a doughlike consistency, and wherein the block is formed by dispensing a predetermined amount thereof onto a suitable surface.

16. A process for the manufacture of a formed cleansing block adapted for slow dissolution in aqueous media, the process comprising the steps of extruding a homogeneous blend comprising a hydrated cellulosic material and a surfactant to obtain a continuous, uncured extrudate; cutting the continuous extrudate into blocks of predetermined size, and permitting the cut blocks to cure.

17. The process of claim 16 wherein the cellulosic material is selected from the group consisting of hydroxyalkyl cellulose having from 1 to about 6 carbons in the alkyl group, carboxyalkyl cellulose having from 1 to about 6 carbons in the alkyl group, hydroxycellulose, cellulose, and alkyl cellulose having from 1 to about 6 carbons in the alkyl group.

18. The process of claim 16 wherein the cellulosic material is hydroxyalkyl cellulose having from 1 to 6 carbons in the alkyl group.

19. The process of claim 18 wherein the alkyl group of the hydroxyalkyl cellulose contains from 1 to 4 carbon atoms.

20. The process of claim 16 wherein the homogeneous blend further omprises one or more of the following optional constituents: an organic oil, a diluent, and an adjuvant selected from the group consisting of dyes, fragrances other than organic oils, and bacteriocides, the process further comprising the step of first hydrating a cellulosic material with a compound containing hydroxy groups available for sorption by said celllosic material, the weight ratio of the cellulosic material to the hydroxy-containing material in the hydrated cellulosic material being from about 30:1 to about 2:1, said hydroxy-containing compound being available as a vehicle for the incorporaion of the surfactant and the optional constituents into the homogeneous blend, the surfactant and the optional constituents being of a nature and of an amount compatible with the proper hydration of the cellulosic material, said homogeneous blend being formed by mixing the cellulosic material and the hydroxy-containing compound and thereafter admixing with the hydrated cellulosic material that portion of the surfactant and of the one or more optional constituents not incorporated with said hydroxy-containing compound.

21. The process of claim 20 wherein the hydroxy-containing compound is about 30% by weight hydroxy or greater 22. The process of claim 21 wherein the hydroxy-containing compound is selected from the group consisting of water, alcohols, and glycols including polyethylene glycols.

23. The process of claim 20 wherein the hydroxy-containing compound is water.

24. The process of claim 22 wherein the cellulosic material is hydroxyalkyl cellulose having from 1 to about 6 carbons in the alkyl group.

25. The process of claim 24 wherein the alkyl group of the hydroxyalkyl cellulose has from 1 to 4 carbon atoms.

26. The process of claim 25 wherein the ratio of hydroxyalkyl cellulose to hydroxy-containing compound is about 10:1 to about 3:1.

27. The process of claim 26 wherein the hydroxy-containing compound is water.

28. The process of claim 27 wherein the homogeneous blend comprises on a weight basis from about 10 to about 50% hydrated hydroxyalkyl cellulose; from about 20 to about 60% of a surfactant selected from the group of anionic and nonionic surfactants; from about 0 to about 15% organic oil; from about 0 to 30% diluent, and less than about 5% each of one or more adjuvants.

29. The process of claim 28 wherein the homogeneous blend is passed through an extruder having a barrel, the barrel being maintained at less than about 110° F.

30. The process of claim 29 wherein the barrel temperature is less than about 95° F., and wherein the extruder die temperature is less than about 120° F.

31. The process of claim 29 wherein the weight ratio of surfactant to hydrated hydroxyalkyl cellulose is from about 1:1 to about 4:1.

32. The process of claim 31 wherein the surfactant is selected from the group consisting of alkyl aryl sulfonates, alpha-olefin sulfonates, fatty alcohol sulfonates, decyl- and tridecyloxypoly(ethyleneoxy) ethanol, and condensation products of ethylene and propylene glycol with ethylene and propylene oxide.

33. The process of claim 29 wherein in the formation of the homogeneous blend the organic oil is introduced in advance of the surfactant.

34. The process of claim 33 wherein the homogeneous blend contains from about 2 to about 10% of an organic oil.

35. The process of claim 34 wherein the organic oil is selected from the group consisting of glycerin, paraffinic and naphthenic hydrocarbons, low molecular weight polyethylene glycols, eugenol, limonene, methyl salicylate, ethyl salicylate and ethyl succinate.

36. The process of claim 34 wherein the organic oil is methylsalicylate.

37. The process of claim 31 wherein the cellulose is hydroxyethyl cellulose.

38. The process of claim 16 wherein the homogeneous blend is passed through an extruder having a barrel, the barrel being maintained at less than about 110° F.

39. A formed cleansing block adapted for slow dissolution in aqueous media comprising on a weight basis from about 10 to about 50% of a hydrated cellulosic material comprising a cellulosic material and a compound containing hydroxy groups available for sorption by the cellulosic material; from about 20 to about 60% of a surfactant selected from the group consisting of anionic and nonionic surfactants; from 0 to about 15% of an organic oil; from 0 to 30% of a diluent and less than about 5% each of one or more adjuvants.

40. The cleaning block of claim 39 wherein the cellulosic material is selected from the group consisting of hydroxyalkyl cellulose having from 1 to about 6 carbons in the alkyl group, carboxyalkyl cellulose having form 1 to about 6 carbons in the alkyl group, hydroxycellulose, cellulose, and alkyl cellulose having from 1 to about 6 carbons in the alkyl group.

41. The cleaning block of claim 40 wherein the cellulosic material is hydroxyalkyl cellulose having from 1 to 6 carbons in the alkyl group.

42. The cleaning block of claim 40 wherein the cellulosic material is an alkali metal salt of carboxymethyl cellulose.

43. The cleansing block of claim 41 wherein the alkyl group of the hydroxalkyl cellulose has from 1 to 4 carbon atoms.

44. The cleansing block of claim 41 wherein the hydroxy-containing compound is at least 30% by weight hydroxy.

45. The cleansing block of claim 44 wherein the hydroxy-containing compound is selected from the group consisting of water, alcohols, and glycols including polyalkylene glycols.

46. The cleansing block of claim 44 wherein the hydroxy-containing compound is water.

47. The cleansing block of claim 45 wherein the weight ratio of hydroxyalkyl cellulose to hydroxy-containing compound in the prehydrated hydroxyalkyl cellulose is from about 30:1 to about 2:1.

48. The cleansing block of claim 46 wherein the ratio of hydroxyalkyl cellulose to the hydroxy-containing compound is from about 10:1 to about 3:1.

49. The cleansing block of claim 39 wherein the block is an extruded article.

50. The cleansing block of claim 49 wherein the surfactant is selected from the group consisting of alkyl aryl sulfonates, alpha-olefin sulfonates, fatty alcohol sulfonates, alcohol ethoxylates, and condensation products of ethylene and propylene glycols with ethylene and propylene oxides.

51. The cleansing block of claim 50 wherein the surfactant concentration is from about 35 to about 50%.

52. The cleansing block of claim 51 wherein the organic oil is present in an amount of from 1 to 10%.

53. The cleansing block of claim 52 wherein the organic oil is selected from the group consisting of glycerin, limonene, methylsalicylate, and ethyl succinate.

54. The cleansing block of claim 52 wherein the organic oil is methyl salicylate.

55. The cleansing block of claim 39 wherein the diluent is present in an amount of from 5 to 20%.

56. The cleansing block of claim 55 wherein the diluent is a soluble alkali metal salt.

57. The cleansing block of claim 55 wherein the diluent is selected from the group consisting of sodium sulfate, magnesium sulfate, sodium borate, sodium chloride and magnesium chloride.

58. The cleansing block of claim 52 wherein the hydrated hydroxyalkyl cellulose is present in an amount of from about 20 to 35%.

59. The cleansing block of claim 56 wherein the cellulose is hydroxyethyl cellulose and wherein the hydroxy-containing compound is water.

60. A surfactant cleansing block made in accordance with the process of claim 1.

61. A surfactant cleansing block made in accordance with the process of claim 16.

62. A surfactant cleansing block made in accordance with the process of claim 33.

63. The process of claim 5 wherein the homogeneous blend is formed by admixing the surfactant, the organic oil, and the diluent to the hydrated cellulosic material.

64. The process of claim 13 wherein the homogeneous blend is formed by admixing the surfactant, the organic oil, and the diluent to the hydrated hydroxyalkyl cellulose.

65. The process of claim 20 wherein the homogeneous blend is formed by admixing the surfactant, the organic oil, and the diluent to the hydrated cellulosic material.

66. The process of claim 28 wherein the homogeneous blend is formed by admixing the surfactant, the organic oil, and the diluent to the hydrated hydroxyalkyl cellulose.

67. The cleansing block of claim 59 wherein the block is an extruded article.

68. An extruded cleansing block adapted for slow dissolution in aqueous media comprising on a weight basis from about 10 to about 40% of a hydrated cellulosic material, the hydrated hydroxyalkyl cellulosic material comprising a hydroxyalkyl cellulose of from 1 to about 4 carbon atoms and a hydroxy-containing compound selected from the group consisting of water, alcohols, and glycols, the weight ratio of the hydroxyalkyl cellulose to the hydroxy-containing compound being from about 10:1 to about 3:1; from about 30 to about 50% of a surfactant selected from the group consisting of alkyl aryl sulfonates, alpha-olefin sulfonates, fatty alcohol sulfonates, alcohol ethoxylates, and the condensation products of ethylene and propylene glycols with ethylene and propylene oxides; from about 2 to 10% of an organic oil selected from limonene, methylsalicylate, ethyl succinate, and glycerin; and from about 5 to about 20% of a water-soluble inorganic alkali or alkaline earth metal salt diluent.

* * * * *